US009042780B2

(12) United States Patent
Ando et al.

(10) Patent No.: US 9,042,780 B2
(45) Date of Patent: May 26, 2015

(54) IMAGE FORMING APPARATUS

(71) Applicant: CANON KABUSHIKI KAISHA, Tokyo (JP)

(72) Inventors: Akifusa Ando, Kashiwa (JP); Yuuichi Tanabe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 14/048,375

(22) Filed: Oct. 8, 2013

(65) Prior Publication Data

US 2014/0099142 A1 Apr. 10, 2014

(30) Foreign Application Priority Data

Oct. 10, 2012 (JP) ..... 2012-225026

(51) Int. Cl.
*G03G 21/00* (2006.01)
*G03G 21/16* (2006.01)

(52) U.S. Cl.
CPC ..... *G03G 21/1633* (2013.01)

(58) Field of Classification Search
CPC ..... G03G 21/1633
USPC ..... 399/110, 124, 167
See application file for complete search history.

(56) References Cited

U.S. PATENT DOCUMENTS

| | | | | |
|---|---|---|---|---|
| 7,903,997 | B2 | 3/2011 | Jung | |
| 2006/0291898 | A1 * | 12/2006 | Ozawa et al. | 399/110 |
| 2012/0148302 | A1 * | 6/2012 | Lee et al. | 399/124 |

* cited by examiner

*Primary Examiner* — Susan Lee
(74) *Attorney, Agent, or Firm* — Canon USA Inc IP Division

(57) ABSTRACT

An image forming apparatus includes a unit housed in an apparatus body and configured to contribute to image formation, a driving source disposed in the apparatus body and configured to apply a driving force to the unit, an opening formed in the apparatus body, a door configured to form a conveyance path for conveying a recording material, and movable between a first position, where the opening is closed, and a second position, where the opening is opened, and a transmission unit configured to transmit the driving force from the driving source to the unit when the door is at the first position and to urge the door in a door closing direction.

11 Claims, 13 Drawing Sheets

DOOR OPENED STATE

DOOR CLOSED STATE

DETAILED DIAGRAM OF CAM MEMBER

CAM DIAGRAM IN DOOR OPENED STATE

CAM DIAGRAM IN DOOR CLOSED STATE

IMAGE FORMING APPARATUS

BACKGROUND OF THE INVENTION

1. Field of the Invention

The present disclosure relates to an image forming apparatus, such as a printer, a copying machine, a facsimile machine, and a multifunctional peripheral thereof, that performs image formation by an appropriate image forming process, such as an electrophotographic image forming process, an electrostatic recording image forming process, and a magnetic recording image forming process.

2. Description of the Related Art

There is an image forming apparatus configured such that a part of its exterior cover is formed as an openable/closable door to enable a user to carry out handling a paper jam. As such an image forming apparatus, for example, a part of a sheet conveyance unit is disposed in the door, and the door is freely opened or closed by using a lower portion of an image forming apparatus body (apparatus body) as a supporting point. During the jamming processing, this door is opened, so that the sheet conveyance unit is widely opened. As a result, handling a paper jam is facilitated.

A certain image forming apparatus includes an openable/closable door for opening an apparatus body to replace a member disposed in the image forming apparatus, such as a cartridge for supplying consumables such as toner or ink, or a rotary drum to be replaced due to aged deterioration. A member, such as the rotary drum, to which a driving force is transmitted and which is replaceable is maintained in a state where the driving force is transmitted during normal time when the door is closed. During maintenance where the door is open, it is desirable to maintain the rotary member in a state where the rotary member does not receive any driving force during the maintenance for facilitating its replacement.

U.S. Pat. No. 7,903,997 discusses a configuration using a connection unit for arranging all components, where opening/closing of a door is performed in conjunction with separation of a driving roller of an intermediate transfer unit, on one axis to achieve the compact door and improve durability.

However, in such a driving connection unit, in a closed state of the door, pressure of the driving connection unit is received in a direction for opening the door. Thus, when the door is a conveyance door where a conveyance path for conveying a sheet is formed together with the apparatus body in the closed state, sheet conveying performance may be affected. To solve the problem, a toggle or a link mechanism may be provided. However, this increases the number of components, causing difficulty in miniaturization of the image forming apparatus, and a production cost increase.

SUMMARY OF THE INVENTION

According to an aspect described herein, an image forming apparatus includes a unit housed in an apparatus body and configured to contribute to image formation, a driving source disposed in the apparatus body and configured to apply a driving force to the unit, an opening formed in the apparatus body, a door configured to form a conveyance path for conveying a recording material, and movable between a first position, where the opening is closed, and a second position, where the opening is opened, and a transmission unit configured to transmit the driving force from the driving source to the unit when the door is at the first position and to urge the door in a door closing direction.

According to the exemplary embodiments of the present disclosure, in an image forming apparatus where driving is transmitted to a unit when a door is closed, and the door forms a recording material conveyance path, since the door is pressed in the closing direction when the door is closed, conveyance of the recording material is stabilized.

Further features of the present invention will become apparent from the following description of exemplary embodiments with reference to the attached drawings.

DESCRIPTION OF THE EMBODIMENTS

(1) Example of Image Forming Apparatus

Figure 1:
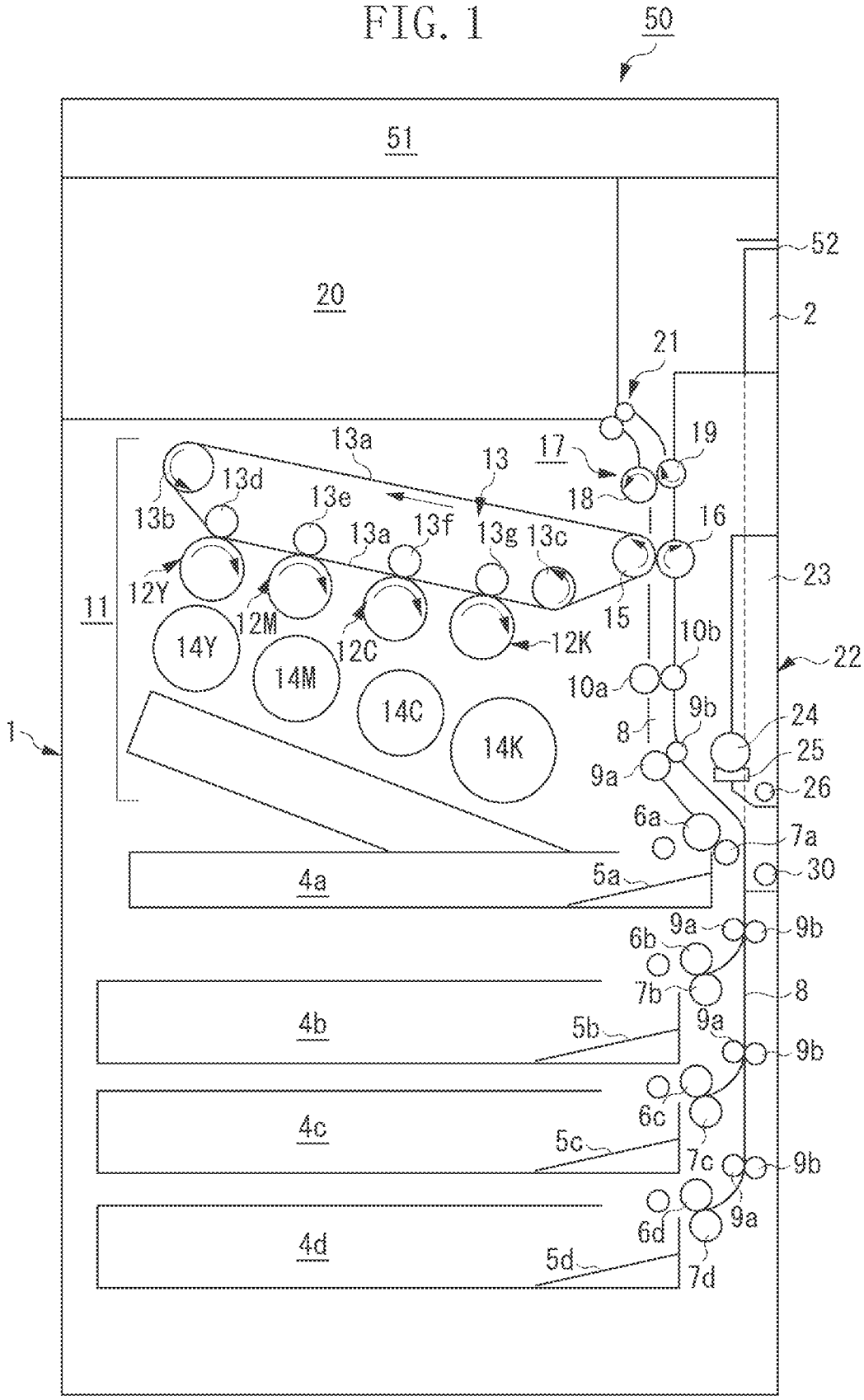
FIG. 1 is a longitudinal front schematic diagram illustrating an outline of an image forming apparatus according to an exemplary embodiment.

FIG. 1 is a longitudinal front schematic diagram illustrating an outline of an image forming apparatus 50 according to the present exemplary embodiment. The image forming apparatus 50 is an electrophotographic four full-color image forming apparatus of an intermediate transfer tandem type, and a multifunctional peripheral having a copying machine function, a printer function, and a facsimile function. Not limited to a full-color image, a monochrome image can be formed.

By placing a document on an image reader (document reading apparatus) 51 mounted on an upper portion of an apparatus body (image forming apparatus body) 1 to read image information in a photoelectric color separation manner, the image forming apparatus can function as a copying machine that outputs an image-formed product corresponding to the image information. The image forming apparatus can function as a facsimile transmission apparatus that transmits the image information to another facsimile apparatus (not illustrated). Further, the image forming apparatus can function as a printer or a facsimile reception apparatus that outputs an image-formed product corresponding to image information transmitted from a personal computer or another facsimile apparatus as an external host apparatus (not illustrated).

A process unit (various units and devices contributing to image formation) 11 is disposed in the apparatus body 1. In the present exemplary embodiment, the process unit includes four first to fourth tandem-arranged image forming units (electrophotographic image forming units), an intermediate transfer unit 13, and a toner bottle 14 (14Y, 14M, 14C, and 14K).

Each of the first to fourth image forming units includes an electrophotographic photosensitive member of a rotary drum type (hereinafter, referred to as a drum) 12 (12Y, 12M, 12C, and 12K), and such process units as a charging unit, an exposure unit, a development unit, and a cleaning unit acting on the drum 12. FIG. 1 representatively illustrates only the drums 12Y, 12M, 12C, and 12K of the four first to fourth image forming units, while omitting the process units acting on the drum 12. The drum 12 of each image forming unit is driven to rotate in a clockwise direction indicated by the arrow at a predetermined peripheral speed (process speed).

In the image forming apparatus 50 of the present exemplary embodiment, a yellow (Y) toner image is formed on the drum 12Y of the first image forming unit. A magenta (M) toner image is formed on the drum 12M of the second image forming unit. A cyan (C) toner image is formed on the drum 12C of the third image forming unit. A black (K) toner image is formed on the drum 12K of the fourth image forming unit.

Y-color toner is stored in the toner bottle 14Y, and the toner is supplied to the development unit of the first image forming unit. M-color toner is stored in the toner bottle 14M, and the toner is supplied to the development unit of the second image forming unit. C-color toner is stored in the toner bottle 14C, and the toner is supplied to the development unit of the third image forming unit. K-color toner is stored in the toner bottle 14K, and the toner is supplied to the development unit of the fourth image forming unit.

The intermediate transfer unit 13 includes a dielectric endless belt (hereinafter, referred to as a belt) 13*a* having flexibility as an intermediate transfer member. The belt 13*a* is stretched and laid on a plurality of rollers in the apparatus body 1, namely, a right driving roller 15, a left driver roller 13*b*, a tension roller 13*c*, and four primary transfer rollers 13*d*, 13*e*, 13*f*, and 13*g* as illustrated. The first to fourth image forming units are sequentially arranged from left to right along a lower side belt portion of the belt 13*a* as illustrated.

The primary transfer roller 13*d* is pressed into contact with an upper surface of the drum 12Y of the first image forming unit via the belt 13*a*, and a contact nip portion between the drum 12Y and the belt 13*a* is a primary transfer nip portion of the first image forming unit. The primary transfer roller 13*e* is pressed into contact with an upper surface of the drum 12M of the second image forming unit via the belt 13*a*, and a contact nip portion between the drum 12M and the belt 13*a* is a primary transfer nip portion of the second image forming unit.

The primary transfer roller 13*f* is pressed into contact with an upper surface of the drum 12C of the third image forming unit via the belt 13*a*, and a contact nip portion between the drum 12C and the belt 13*a* is a primary transfer nip portion of the third image forming unit. The primary transfer roller 13*g* is pressed into contact with an upper surface of the drum 12K of the fourth image forming unit via the belt 13*a*, and a contact nip portion between the drum 12K and the belt 13*a* is a primary transfer nip portion of the fourth image forming unit.

By driving the driving roller 15 to rotate, the belt 13*a* rotates (circulates) in a counterclockwise direction indicated by the arrow at a peripheral speed corresponding to a rotational peripheral speed of the drum 12. A secondary transfer roller 16 is pressed into contact with the driving roller 15 via the belt 13*a*. A contact nip portion between the secondary transfer roller 16 and the belt 13*a* is a secondary transfer nip portion.

The toner images of Y, M, C and K colors respectively formed on the drums 12Y, 12M, 12C, and 12K of the first to fourth image forming units are sequentially superimposed at the respective primary transfer nip portions in a predetermined manner to be transferred to an outer surface of the rotating belt 13*a*. Accordingly, a four-full-color unfixed toner image of Y+M+C+K is formed on the outer surface of the belt having passed through the primary transfer nip portions of the fourth image forming units, and is to be conveyed to the secondary transfer nip portion by subsequent movement of the belt 13*a*.

Below the process unit 11, first to fourth sheet feeding cassettes 4 (4*a*, 4*b*, 4*c*, and 4*d*) are arranged up and down at four stages to constitute a multistage sheet feeding unit. Sheets (recording materials or recording media) are stacked in each sheet feeding cassette 4. In the first to fourth sheet feeding cassettes 4, lifting plates 5 (5*a*, 5*b*, 5*c*, and 5*d*), sheet feeding rollers 6 (6*a*, 6*b*, 6*c*, and 6*d*), and separation rollers 7 (7*a*, 7*b*, 7*c*, and 7*d*) are respectively arranged.

In FIG. 1, a door unit (hereinafter, referred to as a door) 2 is disposed on a right side surface of the apparatus body 1. In other words, a part of an exterior cover of the apparatus body 1 is set as an openable/closable door 2. The door 2 is an opening/closing member movable between a closing position of closing a large opening 52, which is formed in a right side surface plate of the apparatus body 1 and illustrated in FIG. 2, and an opening position of opening the opening 52. The door 2 is attached to the apparatus body 1 to be rotatable around a rotation fulcrum 30 set between the door 2 and the apparatus body 1.

In the present exemplary embodiment, the door 2 is openable/closable to the apparatus body 1 around the rotation fulcrum on the door lower side. An opening/closing operation of the door 2 is carried out by laying a finger on a grip portion (not illustrated) disposed in the door. As illustrated in FIG. 1, the door 2 can be sufficiently rotated to the closing position to be regulated by a regulation unit (not illustrated) to be confined in the apparatus body 1. By closing the door 2, the opening 52 is closed (door closed state).

Figure 2:
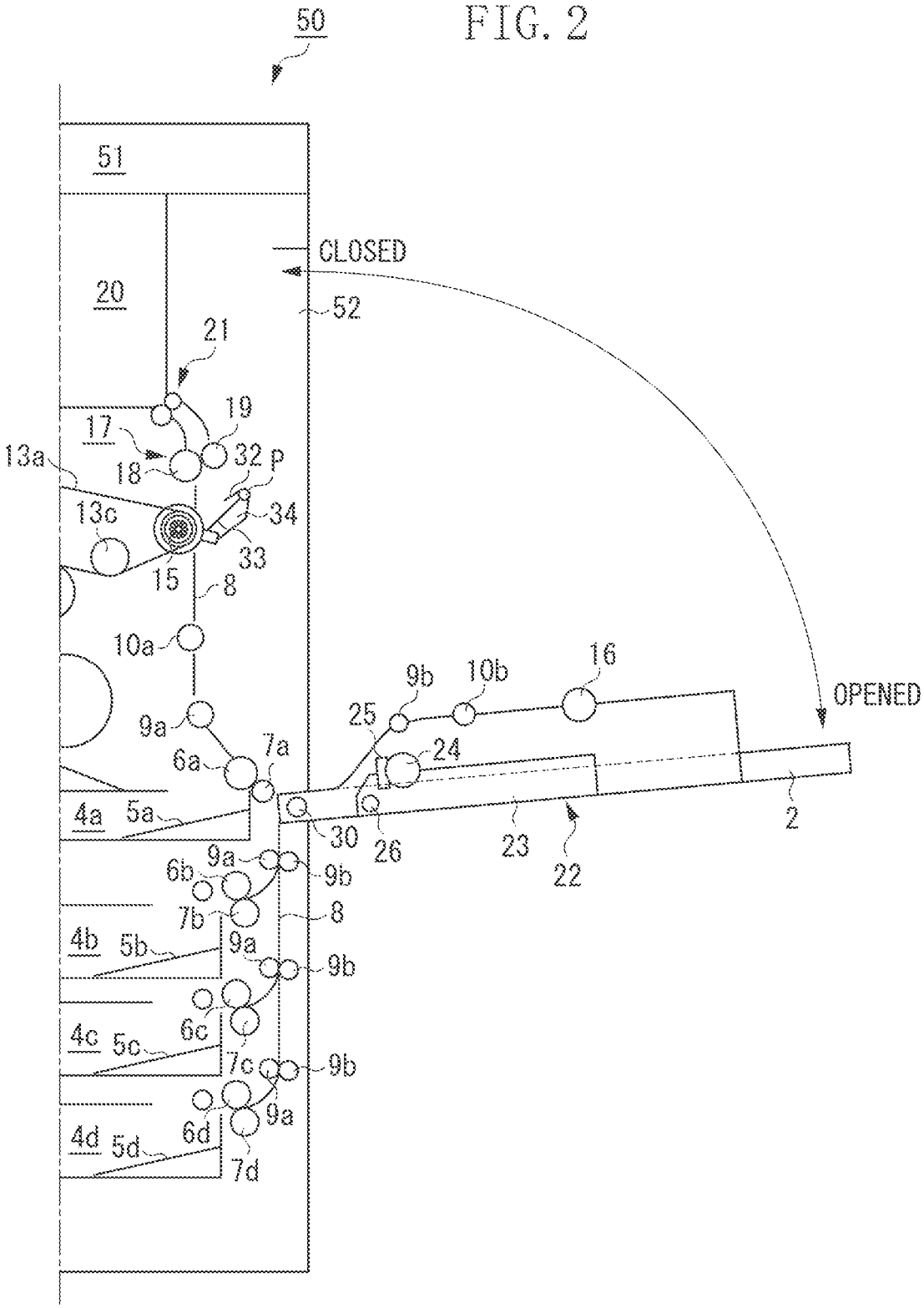
FIG. 2 is a diagram illustrating an opened state of a door in the image forming apparatus illustrated in FIG. 1.

The door 2 can be opened from the apparatus body 1 by being rotated around the rotation fulcrum 30 to the outside (right side) of the apparatus body 1 as illustrated in FIG. 2. The door 2 can be opened and rotated to a predetermined opening position regulated by the regulation unit (not illustrated). Accordingly, the opening 52 is greatly opened (door opened state).

In the present exemplary embodiment, the door 2 is a sheet conveying door that constitutes a part of a vertical conveyance path (recording medium conveyance path) 8 described below for conveying a sheet in the door closed state together with the apparatus body 1. The user can perform sheet jamming processing by opening the door 2 to open a part of the vertical conveyance path 8 directed upward on the right side in the apparatus body 1 as illustrated.

In the present exemplary embodiment, a manual sheet feeding unit (multipurpose tray) 22 is disposed in the door 2. The manual sheet feeding unit 22 includes a manual tray 23, a manual sheet feeding roller 24, and a manual separation pad 25. The tray 23 is attached to the door 2 to be rotatable around a rotation fulcrum 26 set between the tray 23 and the door 2. An opening/closing operation of the tray 23 is carried out by laying a finger on a grip portion (not illustrated) disposed in the tray 23.

In the present exemplary embodiment, the tray 23 is rotatable around the rotation fulcrum 26 of the tray leading edge side (downstream side in sheet conveying direction) for opening/closing to the door 2. During nonuse of the manual sheet feeding unit 22, as illustrated in FIG. 1, the tray 23 can be confined in the door 2. Accordingly, the tray 23 is maintained in a stored state (folded state) in the door 2.

Figure 3:
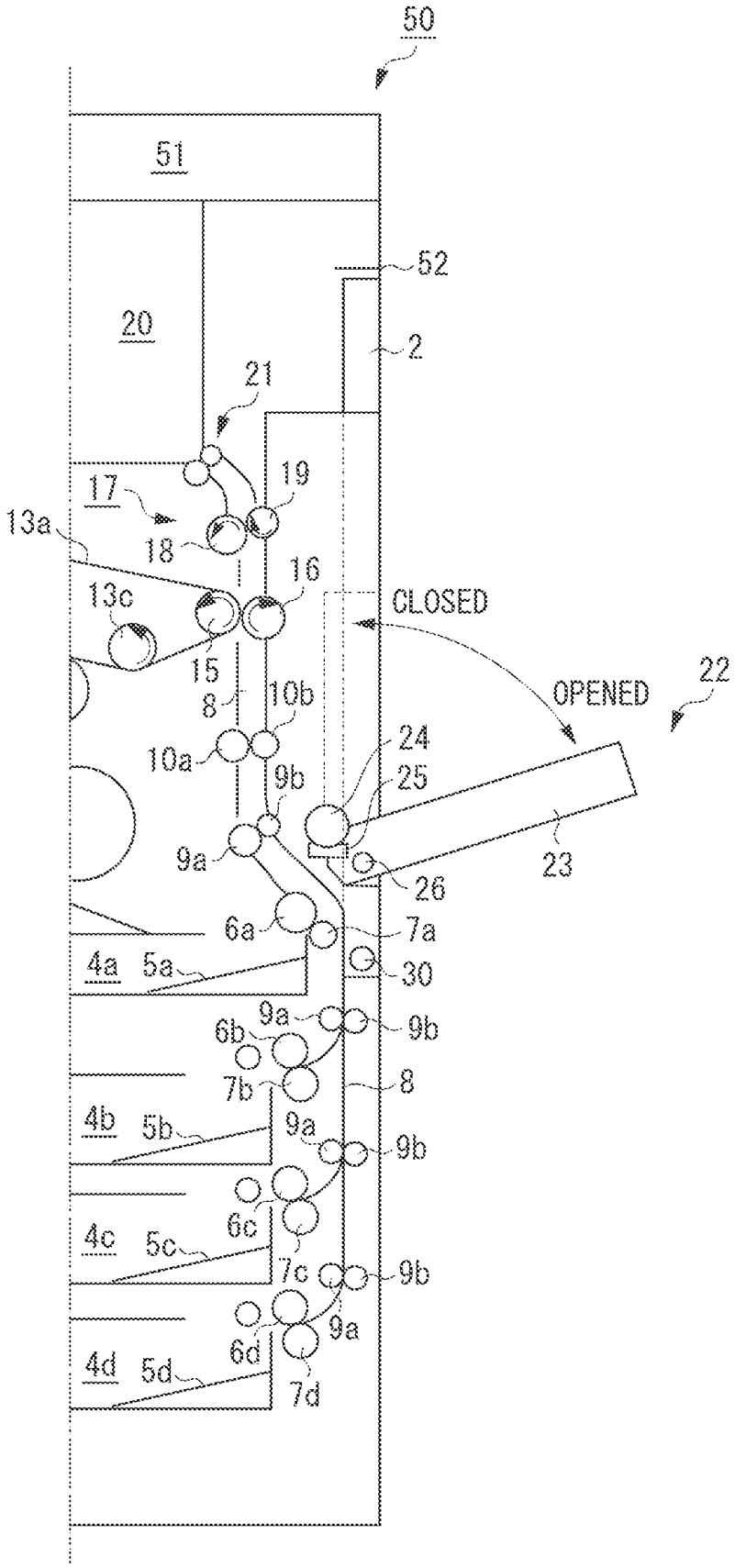
FIG. 3 is a diagram illustrating an opened state of a tray of a manual sheet feeding unit in the image forming apparatus illustrated in FIG. 1.

During use of the manual sheet feeding unit 22, the tray 23 is rotated around the rotation fulcrum 26 to the outside (right side) of the door 2. Accordingly, as illustrated in FIG. 3, the tray 23 can be set in an opened state from the door 2. The door 2 can be opened and rotated to a predetermined opening angle position regulated by a regulating member (not illustrated). Sheets to be manually fed are placed on the opened tray 23.

On the right side in the apparatus body 1, the vertical conveyance path 8 is formed from the multistage sheet feeding unit 4 below the process unit 11 to a sheet discharge unit 20 above the process unit 11. On the vertical conveyance path 8, from the upstream side to the downstream side in the sheet conveying direction, a plurality of pairs of intermediate conveyance rollers 9*a* and 9*b*, registration roller pairs 10*a* and 10*b*, a secondary transfer roller 16, a fixing unit 17, and a sheet discharge roller pair 21, and a sheet guide plate and a sheet guide rib are arranged. The fixing unit 17 includes a fixing roller 18 and a pressure roller 19.

In the case of a cassette sheet feeding mode, a sheet feeding roller of a sheet feeding cassette designated out of the first to fourth sheet feeding cassettes 4*a* to 4*d* is driven. Accordingly, one of the sheets is separated and fed from the sheet feeding cassette of that stage and conveyed upward on the vertical conveyance path 8. In the case of a manual sheet feeding mode, as illustrated in FIG. 3, the tray 23 is opened and the sheet feeding roller 24 of the manual sheet feeding unit 22 is driven on which the sheets have been placed. Thus, one of the sheets is separated and fed from the tray 23 and conveyed upward on the vertical conveyance path 8.

The conveyed sheet is subjected to skew correction by the registration roller pair 10*a* and 10*b*, and is introduced to the secondary transfer nip portion in synchronization with an image forming operation of the process unit 11. Accordingly, the toner images formed on the belt 13*a* are sequentially secondary-transferred to the sheet. The sheet having passed through the secondary transfer nip portion is separated from the belt 13*a*, and introduced to the fixing unit 17 to be subjected to toner-image fixing processing. Then, the sheet passes the fixing unit 17 to be discharged as an image-formed product to the sheet discharge unit 20 by the sheet discharge roller pair 21.

(2) Opening/Closing Configuration of Door 2

In the present exemplary embodiment, on the inner surface side of the door 2, a part of components of a conveyance path disposed from the first sheet feeding cassette 4*a* to the fixing unit 17 on the vertical conveyance path 8 is disposed. In other words, a roller 9*b* of the intermediate conveyance roller pair 9*a* and 9*b*, a roller 10*b* of the registration roller pair 10*a* and 10*b*, the secondary transfer roller 16, the sheet guide plate, and the sheet guide rib are arranged.

Thus, as illustrated in FIG. 2, when the door 2 is opened, the side of the door 2 of a path portion from the first sheet feeding cassette 4*a* to the fixing unit 17 on the vertical conveyance path 8 is opened. Accordingly, sheet jamming processing on the path portion can be carried out. In other words, the sheet which jams the path portion can be easily removed out of the apparatus body 1.

Figure 4:
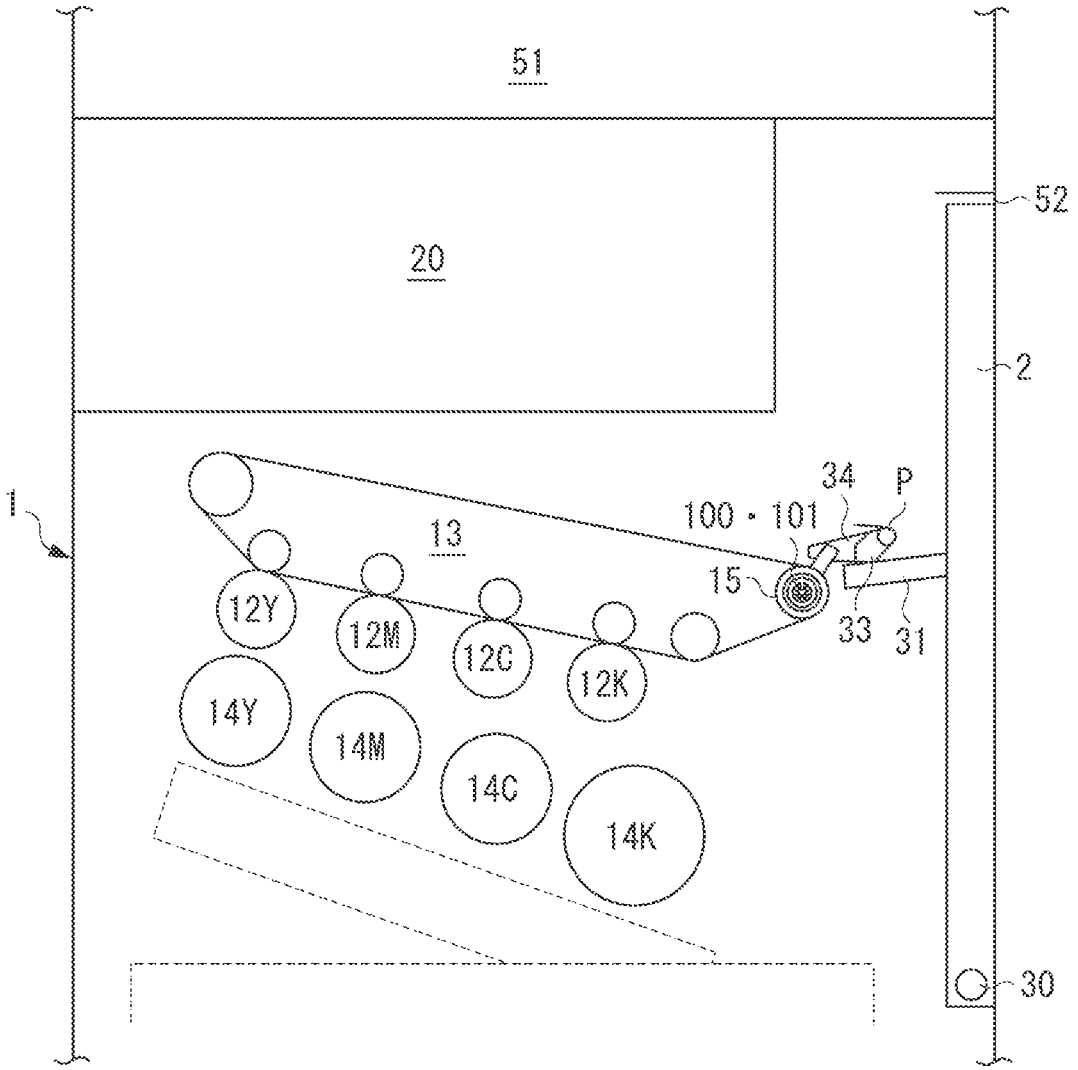
FIG. 4 is a partial schematic diagram of the image forming apparatus illustrating states of a protrusion member and a pressing member when the door is closed.
Figure 5A:
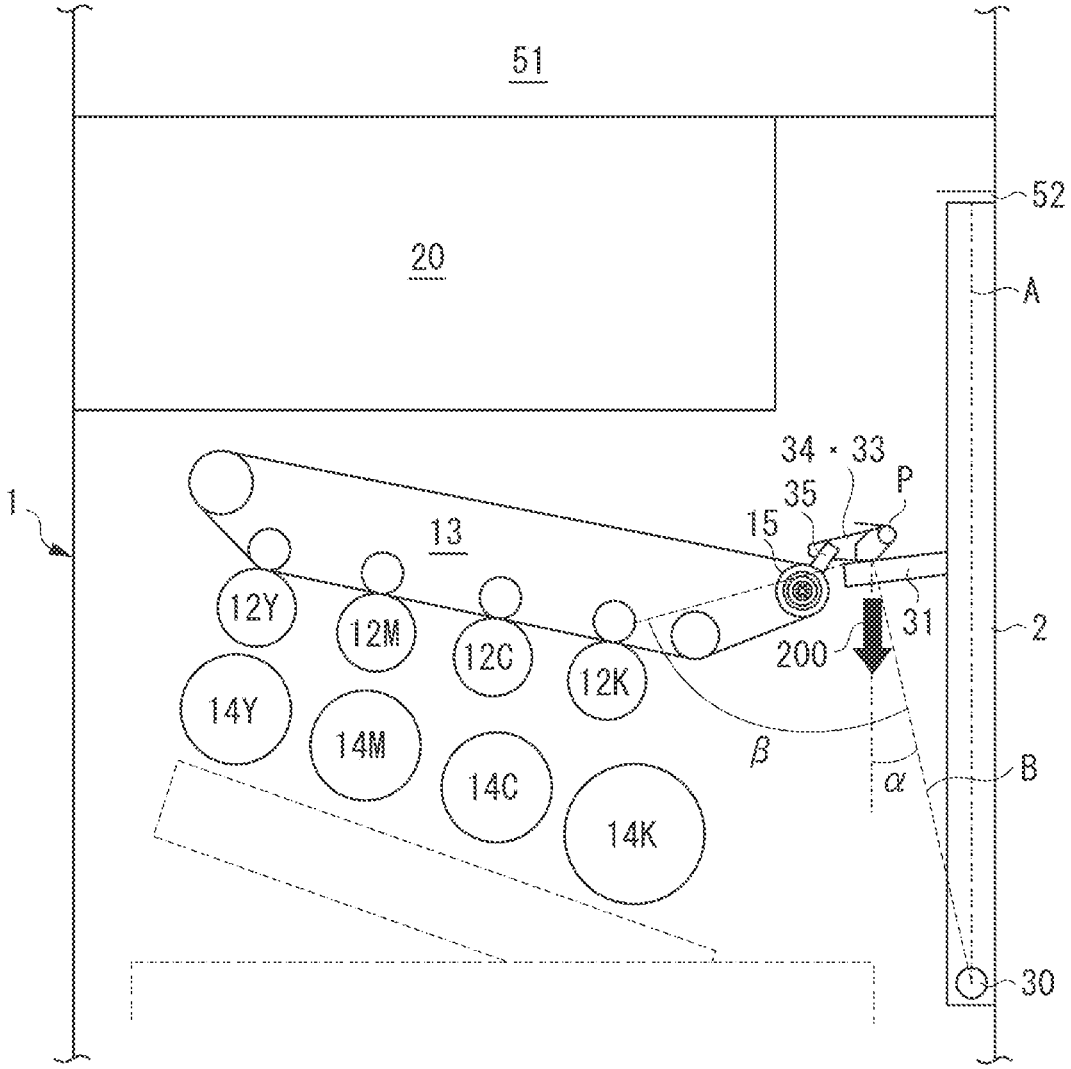
FIG. 5A is a partial schematic diagram of the image forming apparatus illustrating the states of the protrusion member and the pressing member when the door is closed.
Figure 5B:
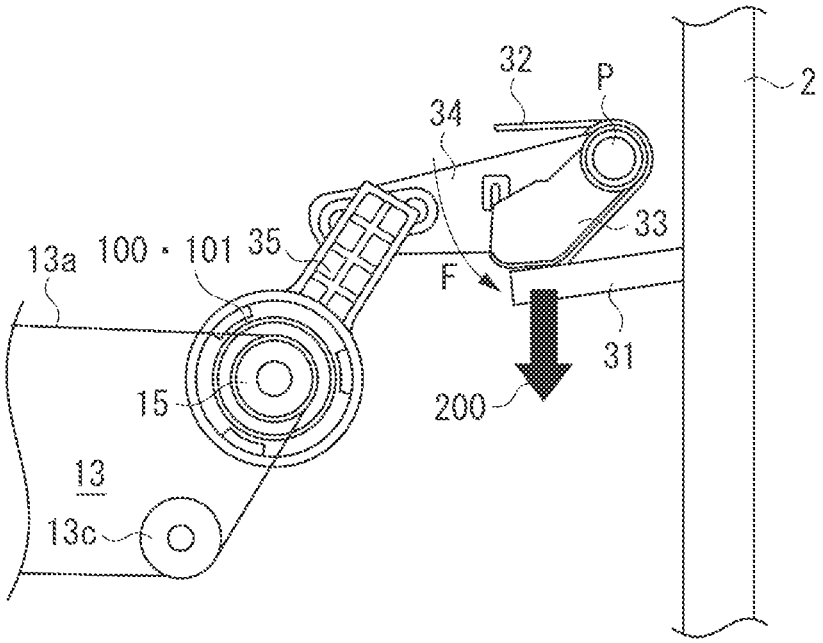
FIG. 5B is an enlarged view illustrating main components of the image forming apparatus.

As illustrated in FIG. 4 and FIGS. 5A and 5B, a protrusion member 31 is disposed on the side of the door 2. A pressing member 34 urged by an elastic member (torsion spring) is disposed on the side of the apparatus body 1. In the door closed state where the door 2 is confined to the opening 52 of the apparatus body 1, the protrusion member 31 contacts a pressing portion 33 of the pressing member 34. In other words, in the door closed state, the pressing member 34 has moved to a first attitude position where the pressing portion 33 is in contact with the protrusion member 31 on the side of the door 2. Thus, the protrusion member 31 is pressed by a pressure force (urging force) 200 of the pressing portion 33 of the pressing member 34 to maintain the door closed state.

Figure 8:
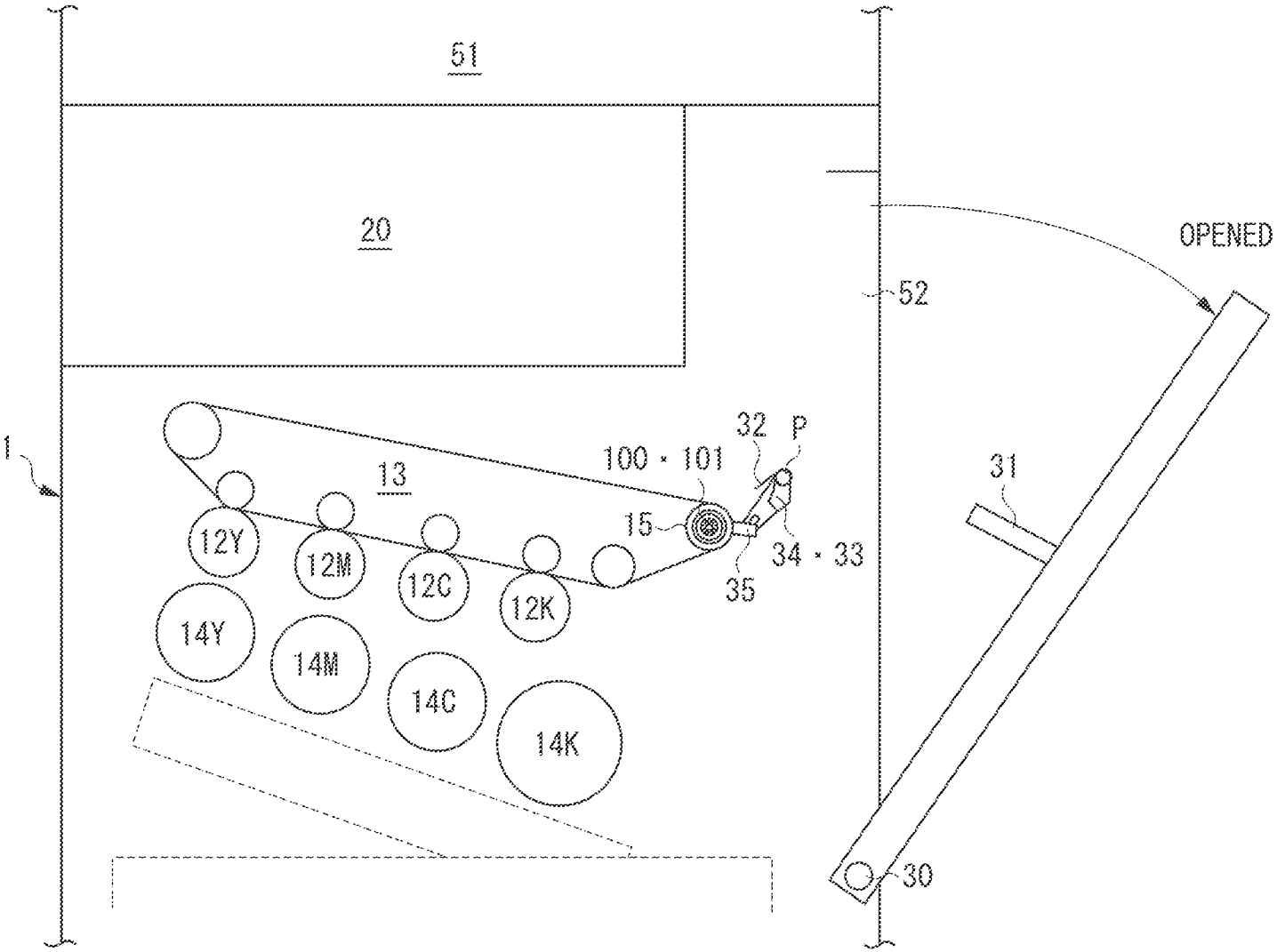
FIG. 8 is a diagram illustrating a midway state of opening of the door in the image forming apparatus illustrated in FIG. 1.

For door opening, the finger is laid on the grip portion of the door 2 to rotate the door in an opening direction against the pressing force 200 of the pressing portion 33 to the protrusion member 31. Then, in initial opening rotation of the door 2, via the process of FIGS. 5A→5B→6A→6B→6C, the protrusion member 31 and the pressing portion 33 are separated from each other to release the opening stopper of the door 2. Then, the door 2 can be continuously opened and rotated as illustrated in FIG. 8 to a predetermined opening position to be regulated by the regulation portion (not illustrated) as illustrated in FIG. 2. Accordingly, the opening 52 is greatly opened (door opened state).

The leading edge of the protrusion member 31 moves while drawing a circular arc locus around the rotation fulcrum 30 following the opening/closing operation of the door 2.

In the present exemplary embodiment, in the inner surface side of the door 2, the protrusion member 31 is disposed on the rear side of the door 2 in the width-direction toward the inside of the apparatus body 1 almost at the center of the door 2 in a height direction. The pressing member 34 is disposed to be rotatable around a support shaft P with respect to a frame (not illustrated) in the rear side of the apparatus body 1. The pressing member 34 is pressed to rotate around the support shaft P in a counterclockwise direction of an arrow F by a pressing force of the elastic member 32 as illustrated in FIG. 5B.

As described above, in the door closed state (FIG. 4, and FIGS. 5A and 5B), an upper surface of the protrusion member 31 of the door 2 confined in the opening 52 contacts a lower surface of the pressing portion 33 of the pressing member 34. Thus, opening of the door 2 is stopped by the pressing force 200 of the pressing portion 33 of the pressing member 34 pressed to rotate by the elastic member 32. At this time, the pressing force 200 of the pressing portion 33 to the protrusion member 31 acts on a position more inside the apparatus body 1 than the rotation fulcrum 30, and a load direction thereof is in a vertical lower direction in the present exemplary embodiment. Since the pressing force 200 is more inside than the rotation fulcrum 30, the pressing force 200 is a drawing force for rotating the door 2 to the side of the apparatus body 1 (inside apparatus body) when the door is closed.

In other words, in the door closed state, the pressing force 200 applied to the protrusion member 31 is not applied in the direction for opening the door 2. Thus, the door 2 as a sheet conveyance door does not affect sheet conveyance performance on the vertical conveyance path 8. An inexpensive highly operable door configuration can be realized with a small number of components.

For the door opening, as described above, the finger is laid on the grip portion of the door 2 to rotate the door 2, opening-stopped by the pressing force 200, around the rotation fulcrum 30 in the opening direction against the pressing force 200. Then, the protrusion member 31 of the door 2 and the pressing portion 33 are separated from each other to open the door. The pressing member 34 separated from the protrusion member 31 is rotated around the support shaft P by the pressing force of the elastic member 32 to a regulated rotational position to be regulated by the regulation unit described below in the counterclockwise direction F illustrated in FIG. 5B to stop as illustrated in FIG. 6C.

In other words, in the door opened state, the pressing member 34 has moved to the regulated rotational position as a second attitude position different from the first attitude position illustrated in FIG. 4 and FIGS. 5A and 5B in the door closed state. FIG. 2, FIG. 6C, and FIG. 7C illustrate a state where the pressing member 34 has rotated to the regulated rotational position to stop.

The opened door 2 is sufficiently rotated to close until it is regulated with respect to the opening 52 by the regulation unit. Then, at a point of time slightly before the end of the closing rotation of the door 2, the leading edge of the protrusion member 31 contacts the pressing portion 33 of the pressing member 34 set at the regulated rotational position (FIGS. 6C→6B).

Figure 6A:
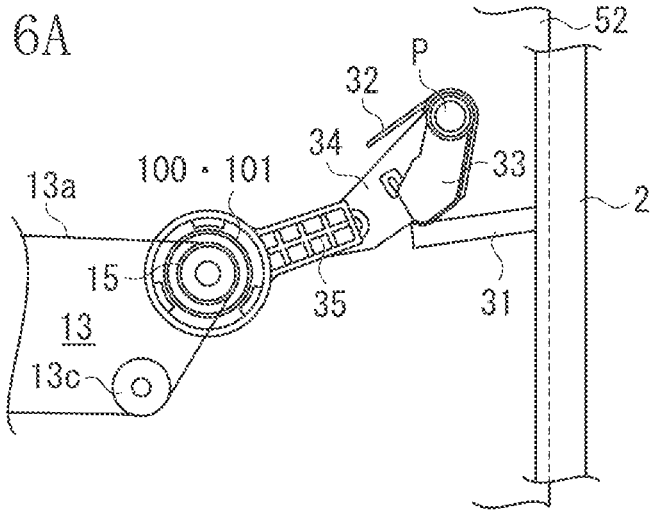
FIGS. 6A, 6B, and 6C are explanatory diagrams of the operation of the protrusion member and the pressing member.

When the door 2 is continuously rotated to close against the pressing force of the elastic member 32, the pressing member 34 is pushed by the protrusion member 31 and rotated around the support shaft P to be pushed back from the regulated rotational position (second attitude position) against the pressing force of the elastic member (FIGS. 6A→6B). Then, lastly, the pressing member 34 is rotated to be pushed back to the rotational position (first attitude position) illustrated in FIG. 5B. Then, the opening of the door 2 is stopped to maintain a door closed state by the pressing force 200 applied by the pressing portion 33 of the pressing member 34 pressed by the elastic member 32.

Figure 7A:
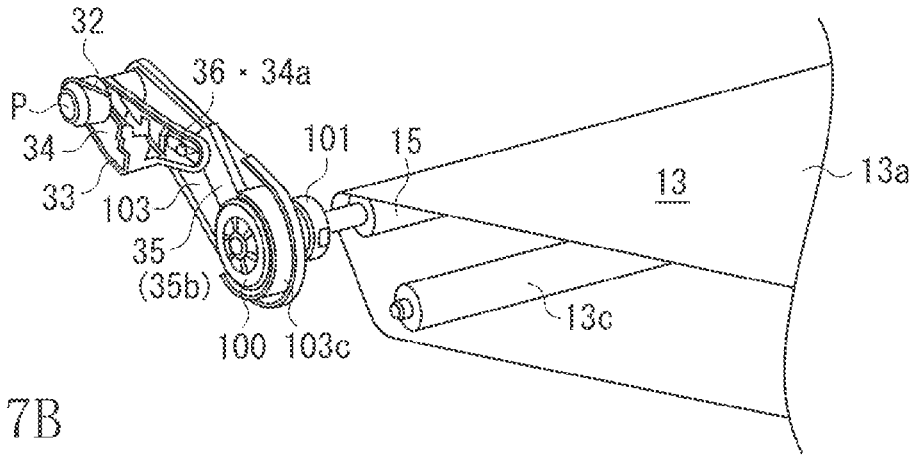
FIG. 7A is a perspective diagram illustrating an interlocking unit portion.
Figure 7B:
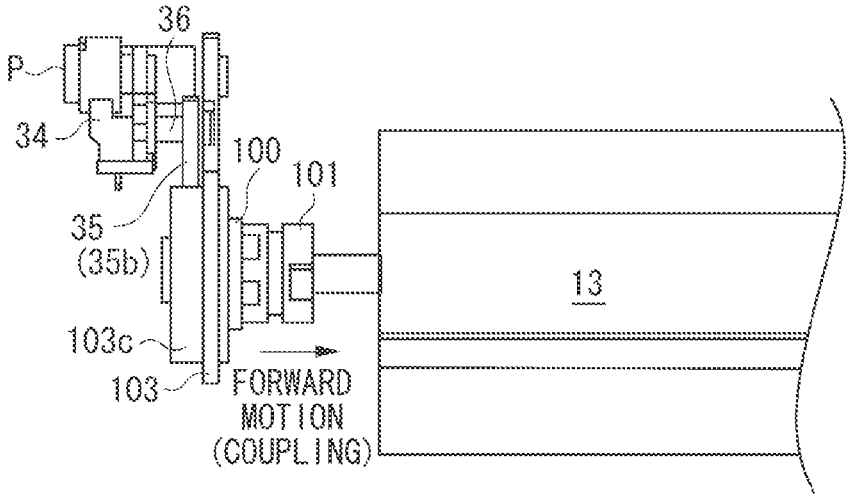
FIG. 7B is a plan view illustrating the interlocking unit portion (when the door is closed).
Figure 7C:
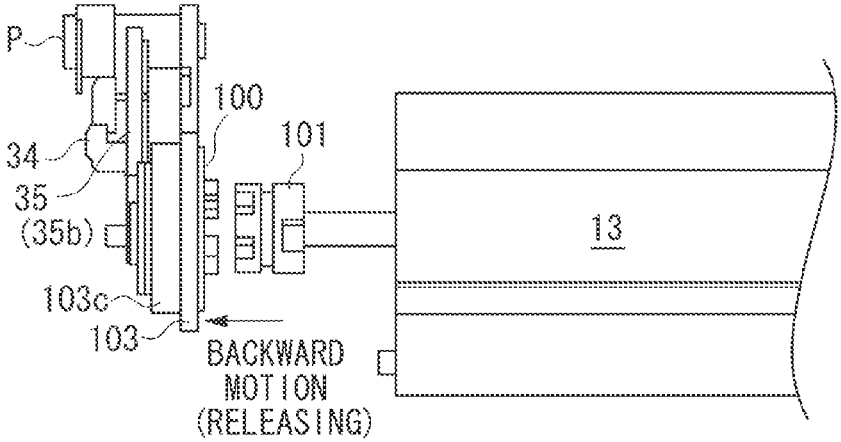
FIG. 7C is a plan view illustrating the interlocking unit portion (when the door is open).

In the present exemplary embodiment, at the rear-side end of the driving roller 15 of the intermediate transfer unit 13, as illustrated in FIGS. 7A to 7C, a driving input coupling (second connection unit) 101 is disposed coaxially with a rotational axis of the driving roller 15. On the rear side of a frame (not illustrated) of the apparatus body 1, a driving output coupling (first connection unit) 100 is disposed at a position facing the driving input coupling 101 and coaxially with the rotational axis of the driving roller 15.

A driving force of a driving source (not illustrated) on the side of the apparatus body 1 is transmitted to the driving output coupling 100. The driving output coupling 100 is disposed to be movable back and forth with respect to the driving input coupling 101. In other words, the driving output coupling 100 is movable back and forth between a coupled position illustrated in FIG. 7B where the intermediate transfer unit 13 is connected to the apparatus body 1 and an uncoupled position illustrated in FIG. 7C where the connection is released.

The driving output coupling 100 is moved forward by a predetermined amount with respect to the driving input coupling 101 to the coupled position, so that the driving output coupling 100 is connected (coupled) to the driving input coupling 101. In that state, the driving force of the driving source on the side of the apparatus body 1 can be input to the driving input coupling 101 from the driving output coupling 100. In other words, the belt 13*a* of the intermediate transfer unit 13 can be driven to rotate by driving the driving roller 15.

The driving output coupling 100 is moved backward by a predetermined amount with respect to the driving input coupling 101 to the uncoupled position, so that the driving output coupling 100 is separated from the driving input coupling 101 to be uncoupled. In that state, the intermediate transfer unit 13 is disconnected from the driving source of the apparatus body 1.

In the present exemplary embodiment, the driving output coupling 100 is moved back and forth in conjunction with the opening/closing motion of the door 2 to connect or disconnect driving with the intermediate transfer unit 13. Specifically, the driving output coupling 100 is moved forward by the user closing the door 2 to connect driving with the intermediate transfer unit 13. Conversely, the driving output coupling 100 is moved backward by the user opening the door 2 to disconnect driving with the intermediate transfer unit 13. Hereinafter, an example of an interlocking unit configuration of the opening/closing motion of the door 2 and back-and-forth movement of the driving output coupling 100 will be described.

Figure 9A:
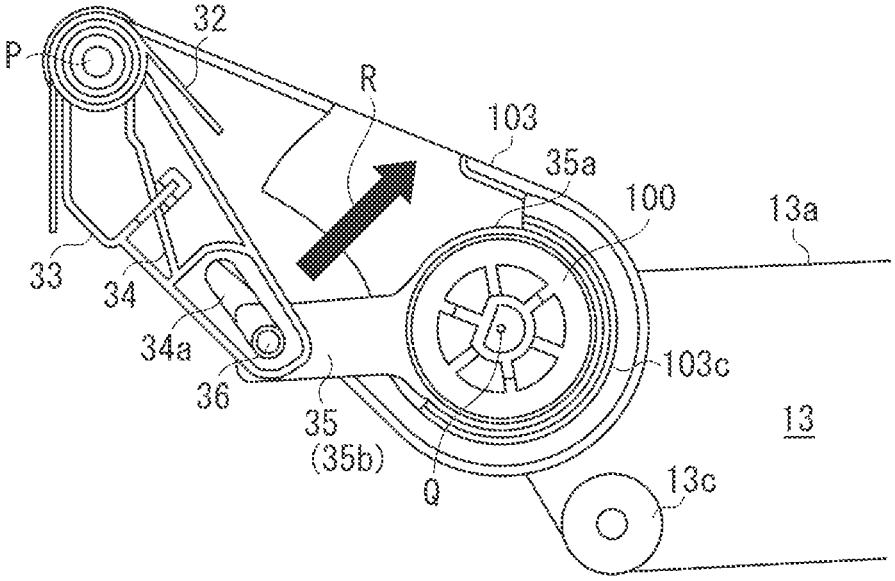
FIG. 9A is a diagram illustrating an operation of an interlocking unit (when the door is open).
Figure 9B:
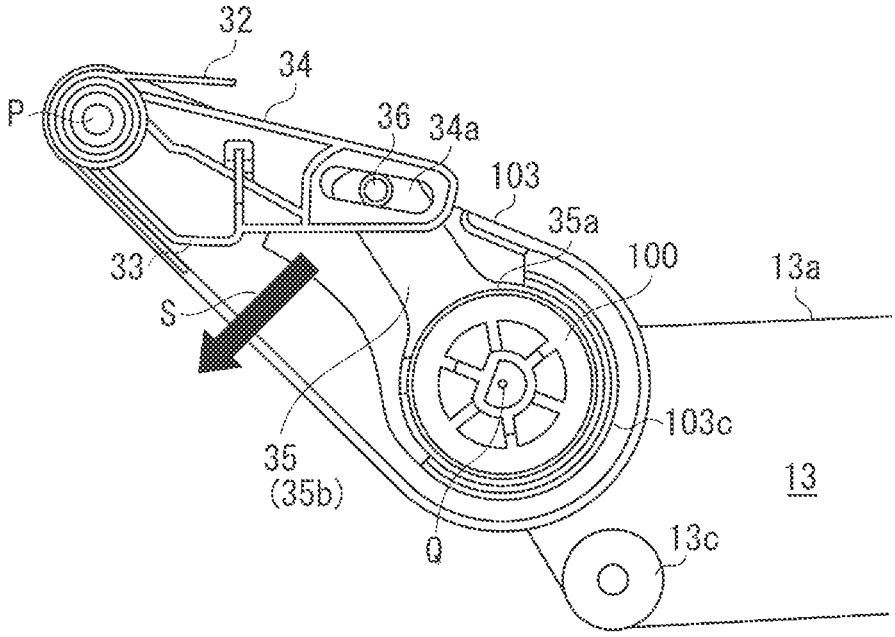
FIG. 9B is a diagram illustrating an operation of the interlocking unit (when the door is closed).
Figure 10A:
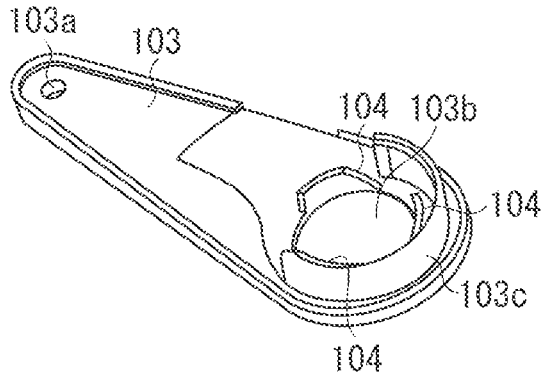
FIGS. 10A to 10C are diagrams each illustrating a configuration of the interlocking unit.

In FIGS. 7A to 7C, FIGS. 9A and 9B, and FIGS. 10A to 10C, a cam member 103 serving as a substrate of the interlocking unit configuration is disposed between the support shaft P of the pressing member 34 and the driving output coupling 100. FIG. 10A is a perspective diagram illustrating a surface side (rear surface side) of the cam member 103. A shaft hole 103*a* is formed on one end side of the cam member 103. By engaging the shaft hole 13*a* with the leading edge of the support shaft P of the pressing member 34, the one end side of the cam member 34 is positioned at the support shaft P to be supported. On the other end side of the cam member 103, a circular hole 103*b* is formed, through which the driving output coupling 100 enters and exits.

In the circular hole 103*b*, a plurality of cam surfaces (slope cams) 104 are arranged at equal intervals along the hole edge. Outside the circular hole 103*b*, a semicircular guide convex edge 103*c* is disposed concentrically to the circular hole 103*b*.

Figure 10B:
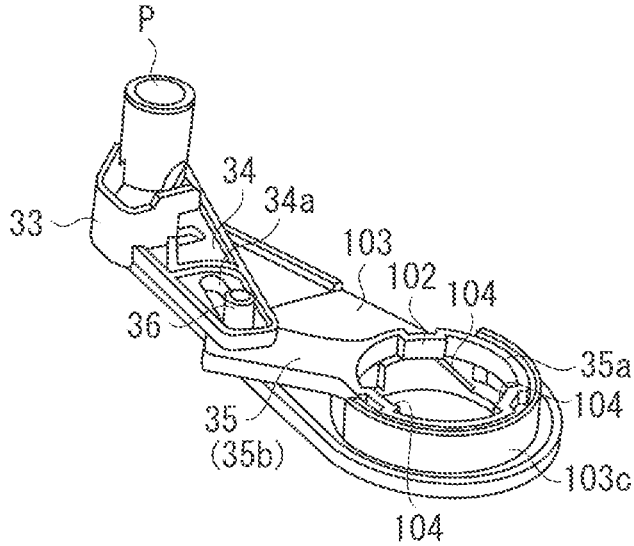

In FIG. 10B, a cam connection member 35 includes a ring-shaped portion 35*a* fitted between the outside of the plurality of cam surfaces 104 arranged along the hole edge of the circular hole 103*b* of the cam member 103 and the inside of the semicircular guide convex edge 103*c*, and an arm portion 35*b* formed integrally with the ring-shaped portion 35*a*. In the inner peripheral portion of the ring-shaped portion 35*a*, a plurality of connection cam portions 102 are arranged along the circumference at equal intervals. Each of the plurality of connection cam portions 102 corresponds to each of the plurality of cam surfaces 104 on the side of the cam member 103.

Figure 10C:
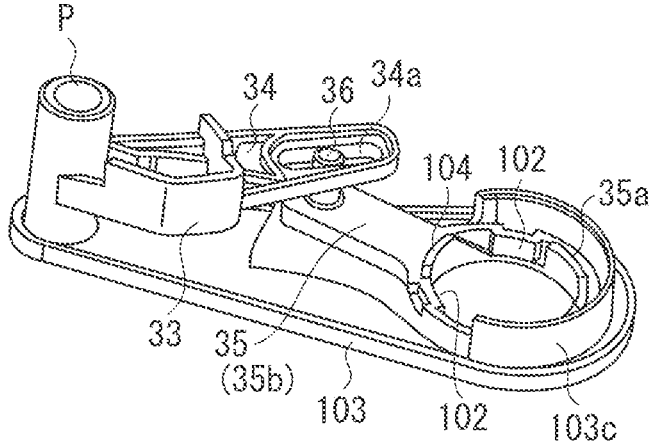

The cam connection member 35 is rotatable concentrically to the circular hole 103*b* with the ring-shaped portion 35*a* guided by the semicircular guide convex edge 103*c*. The cam connection member 35 is moved (backward) in a direction away from the circular hole 103*b* with respect to the cam member 103 by the connection cam portions 102 of the ring-shaped portion 35*a* being rotated in a direction for riding on a top of the cam surface 104 of the cam member 103 as illustrated in FIG. 10B. The cam connection member 35 is moved (forward) in a direction for approaching the circular hole 103*b* with respect to the cam member 103 by the connection cam portions 102 of the ring-shaped portion 35*a* being rotated in a direction descending to a bottom portion of the cam surface 104 of the cam member 103 as illustrated in FIG. 10C.

The ring-shaped portion 35*a* of the cam connection member 35 is rotatably fitted into the leading edge of the driving output coupling 100 to be engaged. The driving output coupling 100 is moved and pressed by a pressing member (spring not illustrated) toward the direction where the driving output coupling 100 presses an engaging portion against the ring-shaped portion 35*a* of the cam connection member 35. In other words, the driving output coupling 100 is moved and pressed by a predetermined pressing force in a forward moving direction with respect to the driving input coupling 101. The guide convex edge 103*c* of the cam member 103 is fixed to the rear-side frame on the side of the apparatus body 1. In other words, the cam member 103 is fixed to the rear-side frame on the side of the apparatus body 1.

A boss portion 36 is implanted in the end of the arm portion 35*b* of the cam connection member 35. A long hole 34*a* formed on the side of the pressing member 34 is engaged with the boss portion 36. In other words, the pressing member 34 and the cam connection member 35 are connected to the boss portion 36 via the long hole 34*a*. In FIGS. 2, 4, 5A and 5B, 6A to 6C, and FIG. 8, the cam member 103 is omitted to facilitate visualization.

In the present exemplary embodiment, the cam member 103, the cam connection member 35, the long hole 34*a* on the side of the pressing member 34, and the boss portion 36 on the side of the cam connection member 35 constitute an interlocking unit of the opening/closing motion of the door 2 and the back-and-forth movement of the driving output coupling 100.

The interlocking unit interlocks the driving output coupling 100 with the pressing member 34 so that, when the pressing member 34 is moved to the first attitude position illustrated in FIG. 4 and FIGS. 5A and 5B, the driving output coupling 100 serving as the connection unit can be moved to the coupled position illustrated in FIG. 7B. The interlocking unit interlocks the driving output coupling 100 with the pressing member 34 so that, when the pressing member 34 is moved to the second attitude position illustrated in FIGS. 2 and 8, the driving output coupling 100 can be moved to the uncoupled position illustrated in FIG. 7C.

1) Operation During Shifting from Door Opened State to Door Closed State

FIG. 9A illustrates the state of a rotational attitude of the pressing member 34 and the cam connection member 35 in the door opened state. In the door opened state, the protrusion member 31 on the side of the door 2 is not in contact with the pressing portion 33 of the pressing member 34 as illustrated in FIGS. 2, 6C and 8. Accordingly, the pressing member 34 is rotated around the support shaft P in a clockwise direction illustrated in FIG. 9A by the pressing force of the elastic member 32 to a predetermined regulated rotational position.

Specifically, as illustrated in FIG. 9A, the rotation of the pressing member 34 is regulated to an angle of a state where the boss portion 36 on the side of the cam connection member 35 moves through the long hole 34*a* on the side of the pressing member 34 to the leading edge, and reaches the leading edge end of the long hole 34 to be prevented from further movement. The regulated rotation angle is the regulated rotational position (second attitude position) of the pressing member 34.

In the rotated state of the pressing member 34 to the regulated rotational position, the cam connection member 35 connected by the boss portion 36 and the long hole 3*a* has the connection cam portions 102 being rotated in a direction for riding on the top of the cam surface 104 of the cam member 103 as illustrated in FIG. 10B. In other words, the cam connection member 35 moves in a direction away from the circular hole 103*b* with respect to the cam member 103.

Accordingly, the driving output coupling 100 engaged with the cam connection member 35 moves backward by a predetermined amount from the driving input coupling 101 against the pressing force of the pressing member in the forward moving direction to be maintained at a backward position illustrated in FIG. 7C where driving with the intermediate transfer unit 13 has been released. The pressing force of the pressing member for pressing the driving output coupling 100 in the forward moving direction is set smaller than that of the pressing member 34.

In the door opened state, the door 2 is sufficiently rotated to close until the door 2 is regulated with respect to the apparatus body 1 by the regulation unit. Then, at a point of time slightly before the end of the closing rotation of the door 2, the leading edge of the protrusion member 31 contacts with the pressing portion 33 of the pressing member 34 set at the regulated rotational position (FIGS. 6C→6B). When the door 2 is continuously rotated to close against the pressing force of the elastic member 32, the pressing portion 33 of the pressing member 34 is pushed by the protrusion member 31 to be pushed back and rotated around the support shaft P in the direction indicated by an arrow R illustrated in FIG. 9A against the pressing force of the elastic member 32.

Figure 6B:
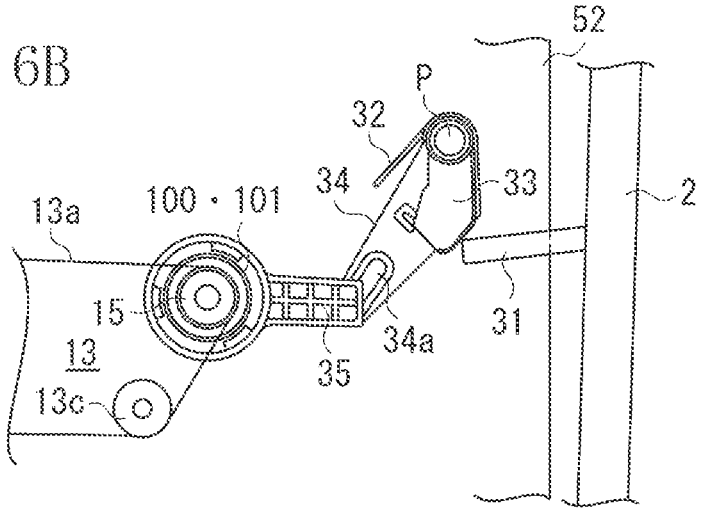
Figure 6C:
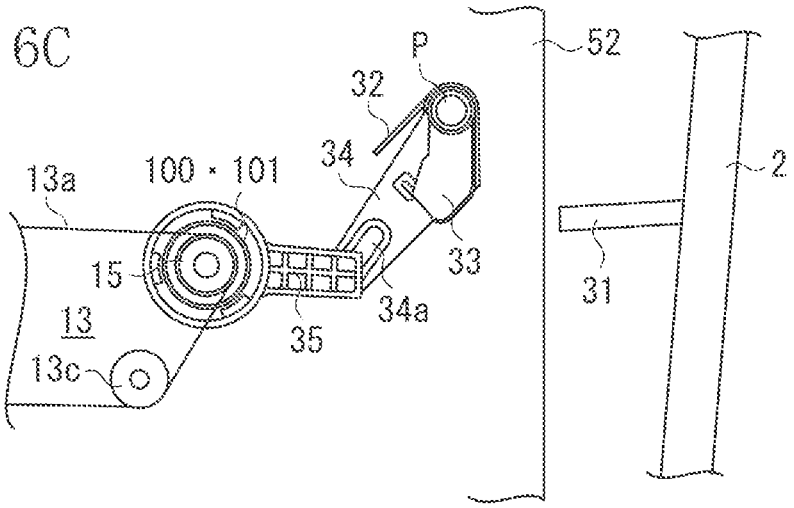

Thus, the pressing member 34 is shifted from the state illustrated in FIG. 9A to a state (first attitude position) illustrated in FIG. 9B (FIGS. 6B→6A→5B).

Then, lastly, the pressing member 34 is rotated to be pushed back to the rotational position illustrated in FIG. 5A and FIG. 9B. Then, the opening of the door 2 is stopped to maintain a door closed state by the pressing force 200 applied by the pressing portion 33 of the pressing member 34 pressed by the elastic member 32. In FIG. 9B, the protrusion member 31 is omitted.

The cam connection member 35 connected to the pressing member 34 via the boss portion 36 and the long hole 34*a* also rotates in conjunction with the rotation of the pressing member 34. Specifically, accompanied with the cam connection member 35, the pressing member 34 is rotated around a center Q of the driving output coupling 100 in the direction indicated by the arrow R illustrated in FIG. 9A to shift from the state illustrated in FIG. 9A to that illustrated in FIG. 9B. Accordingly, the connection cam portions 102 of the ring-shaped portion 35*a* of the cam connection member 35 is rotated in a direction where the connection cam portions 102 descend from the top of the cam surface 104 of the cam member 103 to the bottom portion to shift from the state illustrated in FIG. 10B to that illustrated in FIG. 10C. In other words, the cam connection member 35 moves in a direction where the cam connection member 35 approaches the circular hole 103*b* with respect to the cam member 103.

Thus, the driving output coupling 100 engaged with the cam connection member 35 is moved forward in a direction where the driving output coupling 100 couples with the driving input coupling 101 by the pressing force of the pressing member to connect driving with the intermediate transfer unit 13 as illustrated in FIG. 7B.

2) Operation During Shifting from Door Closed State to Door Opened State

The pressing portion 33 of the pressing member 34 on the side of the apparatus body 1 and the protrusion member 31 on the side of the door 2 contacted with each other in the door closed state are set in noncontact with each other when a door opened state is set (FIG. 5B→FIG. 6A→FIGS. 6B→6C). Accordingly, the pressing member 34 is rotated around the support shaft P in the direction indicated by an arrow S illustrated in FIG. 9B by the pressing force of the elastic member 32 to shift from the state illustrated in FIG. 9B to that illustrated in FIG. 9A where the pressing member 34 has rotated to a predetermined regulated rotational position.

The cam connection member 35 connected to the pressing member 34 via the boss portion 36 and the long hole 34*a* also rotates in conjunction with the rotation of the pressing member 34. Specifically, accompanied with the cam connection member 35, the pressing member 34 is rotated around the center Q of the driving output coupling 100 in the direction indicated by the arrow S illustrated in FIG. 9B to shift from the state illustrated in FIG. 9B to that illustrated in FIG. 9A. Accordingly, the connection cam portion 102 of the ring-shaped portion 35*a* of the cam connection member 35 is rotated in a direction where the connection cam portions 102 ride on the top from the bottom portion of the cam surface 104 of the cam member 103 to shift from the state illustrated in FIG. 10C to that illustrated in FIG. 10B.

In other words, the cam connection member 35 moves in a direction away from the circular hole 103*b* with respect to the cam member 103. Accordingly, the driving output coupling 100 engaged with the cam connection member 35 moves backward by a predetermined amount in a direction away from the driving input coupling 101 against the pressing force of the pressing member for pressing the driving output coupling 100 in the forward moving direction. By the backward movement, the coupling of the driving output coupling 100 with the driving input coupling 101 is released as illustrated in FIG. 7C to disconnect the intermediate transfer unit 13 from the driving source on the side of the apparatus body 1.

In the present exemplary embodiment, the intermediate transfer unit 13 is detachable from the apparatus body 1 in a state where the door has been opened and the driving output coupling 100 is moved to a uncoupled position. In other words, the intermediate transfer unit 13 is detachable from the apparatus body 1 in a vertical direction to the back-and-forth moving direction of the driving output coupling 100 by a predetermined procedure.

Figure 11A:
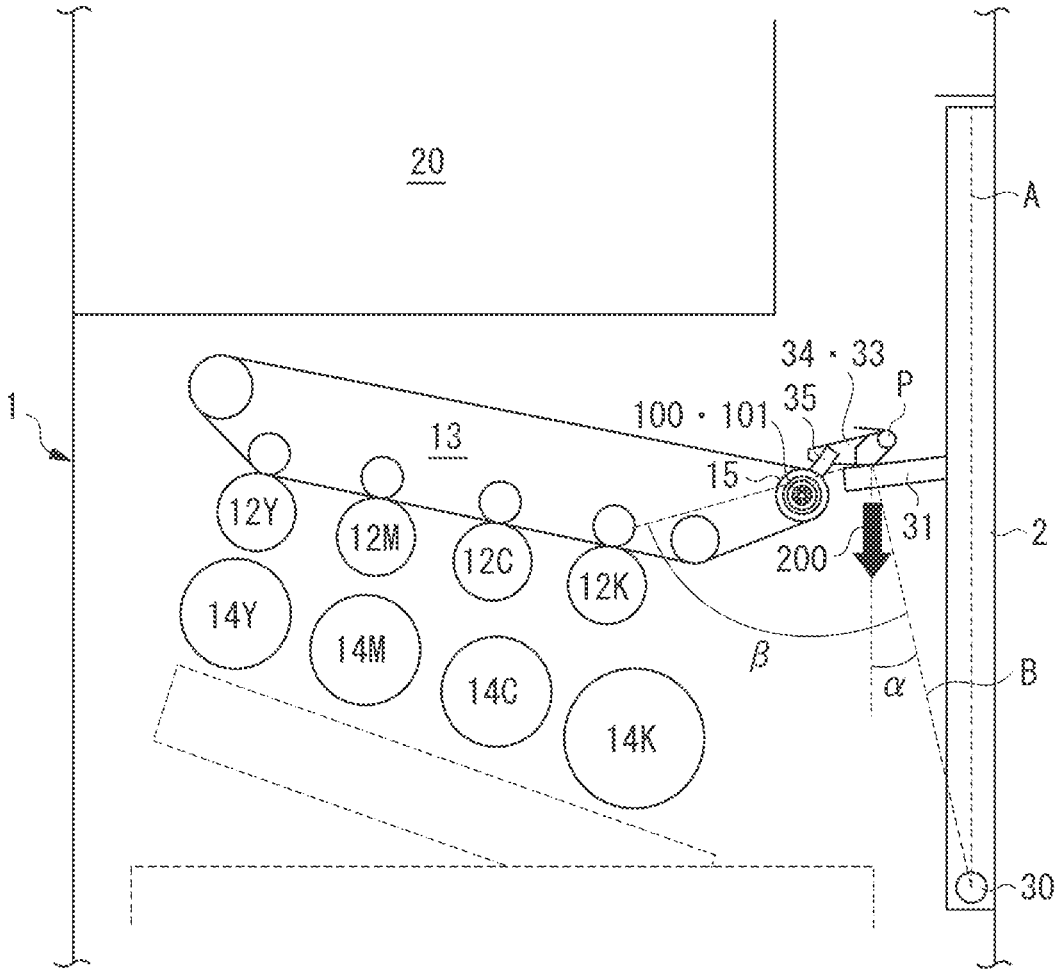
FIG. 11A is a partial schematic diagram of the image forming apparatus illustrating the states of the protrusion member and the pressing member when the door is closed.
Figure 11B:
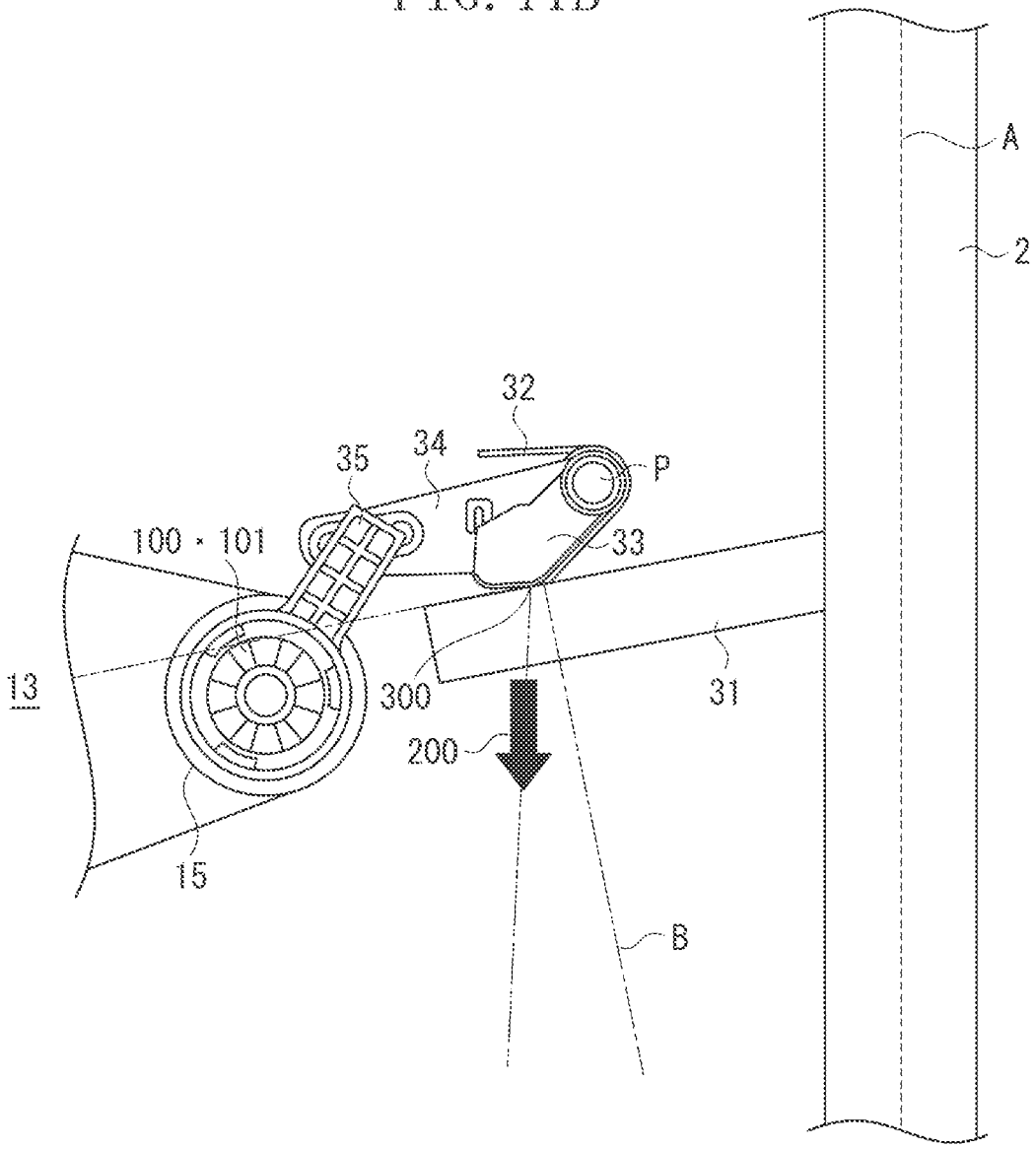
FIG. 11B is an enlarged view illustrating main components of the image forming apparatus.

Next, referring to FIGS. 11A and 11B, a positional relationship between an application point 300 of the pressing force 200, where the door 2 is pulled in, and the rotation fulcrum 30 in the door closed state will be described. In FIGS. 11A and 11B, for easier visualization, the cam member 103 is omitted.

The application point 300 is located on a line A drawn from the rotation fulcrum 30 to the leading edge of the door or more inside the apparatus body 1 than the line A. A working angle $\alpha$ of the pressing force 200 can be set up to 90° in a direction toward the inside of the body around the application point 300 of the end of a line segment B that connects the application point 300 and the rotation fulcrum 30.

With the configuration, the pressing force applied to the protrusion member 31 in the door closed state is not applied in the direction for opening the door 2. Thus, an inexpensive and highly operable configuration can be realized with a small number of components without affecting sheet conveyance performance on the vertical conveyance path 8.

The exemplary embodiment of the present invention has been described. However, exemplary embodiments of the present invention is not limited to the above exemplary embodiment. Various modifications can be made within the technical ideas of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-225026 filed Oct. 10, 2012, which is hereby incorporated by reference herein in its entirety.

What is claimed is:

1. An image forming apparatus comprising:

a unit housed in an apparatus body and configured to contribute to image formation;

a driving source disposed in the apparatus body and configured to apply a driving force to the unit;

an opening formed in the apparatus body;

a door configured to form a conveyance path for conveying a recording material, and movable between a first position, where the opening is closed, and a second position, where the opening is opened; and a transmission unit configured to urge the door in a door closing direction when the door is at the first position, the transmission unit transmitting the driving force from the driving source to the unit when the door is at the first position.

2. The image forming apparatus according to claim 1, wherein, when the door is at the second position, the unit is exposed from the opening and the transmission unit releases the transmission of the driving force from the driving source to the unit.

3. The image forming apparatus according to claim 2, wherein the transmission unit includes an urging member configured to urge the transmission unit in the door closing direction when the door is at the first position, and wherein the transmission unit is switched, according to an operation of moving the door from the first position to the second position, from a first state where the driving force is transmitted from the driving source to the unit to a second state where the transmission of the driving force from the driving source to the unit is released, by a urging force of the urging member.

4. The image forming apparatus according to claim 3, wherein the transmission unit includes a rotatable contact member configured to contact, when the door is at the first position, the door, while the contact member is urged in a first rotational direction by the urging member to be regulated at a first rotational position, a regulating member configured to regulate, when the door is at the second position, rotation of the contact member toward the first rotational direction by the urging member at a second rotational position on a downstream side of the first rotational position in the first rotational direction, and a switching mechanism configured to switch the transmission of the driving force from the first state to the second state according to the rotation of the contact member from the first rotational position to the second rotational position, and wherein, when moving the door from the first position to the second position, after the contact member deviates from a movement locus of the door to separate from the door, the contact member is rotated in the first rotational direction to the second rotational position.

5. The image forming apparatus according to claim 4, wherein, when moving the door from the second position to the first position, after the contact member enters into the movement locus of the door to contact the door, the contact member is rotated in the second rotational direction to the first rotational position.

6. The image forming apparatus according to claim 5, wherein the door includes a contacted portion configured to contact the contact member and disposed on an apparatus body side of the door when the door is at the first position.

7. The image forming apparatus according to claim 6, wherein, when the door is at the first position, the recording material is conveyed via the conveyance path, and wherein, when the door is at the second position, the recording material retained on the conveyance path is removable from the opening to an outside of the apparatus body.

8. The image forming apparatus according to claim 1, wherein, when the door is at the second position, the unit is detachable from the apparatus body.

9. The image forming apparatus according to claim 1, further comprising a toner image forming unit configured to form a toner image, wherein the unit is an intermediate transfer belt unit having an intermediate transfer belt for bearing toner transferred from the toner image forming unit.

10. The image forming apparatus according to claim 1, further comprising a toner image forming unit configured to form a toner image, wherein the unit is a recording material conveyance belt unit having a recording material conveyance belt for bearing and conveying the recording material to which toner is transferred from the toner image forming unit.

11. The image forming apparatus according to claim 1, wherein one of the apparatus body and the door includes an axis of rotation, which rotates the door with respect to the apparatus body and is disposed below the apparatus body.

* * * * *